United States Patent [19]

Inayama et al.

[11] 4,297,558

[45] Oct. 27, 1981

[54] COMPOSITE COOKING DEVICE

[75] Inventors: Minoru Inayama, Komaki; Yukio Furukawa, Konan, both of Japan

[73] Assignee: Rinnai Kabushiki Kaisha, Nagoya, Japan

[21] Appl. No.: 143,873

[22] Filed: Apr. 25, 1980

[30] Foreign Application Priority Data

May 1, 1979 [JP] Japan ..... 54-57047

[51] Int. Cl.[3] ..... H05B 6/64

[52] U.S. Cl. ..... 219/10.55 R; 219/10.55 B; 219/10.55 F

[58] Field of Search ..... 219/10.55 R, 10.55 B, 219/10.55 F, 10.55 A, 10.55 M

[56] References Cited

U.S. PATENT DOCUMENTS

| | | | |
|---|---|---|---|
| 2,860,026 | 11/1958 | Long | 219/10.55 R |
| 3,654,417 | 4/1972 | Javes et al. | 219/10.55 R |
| 3,818,171 | 6/1974 | Miller et al. | 219/10.55 R |
| 4,123,643 | 10/1978 | Burke | 219/10.55 R |

*Primary Examiner*—Arthur T. Grimley

*Attorney, Agent, or Firm*—Haseltine & Lake

[57] ABSTRACT

The present application discloses a composite cooking device of the type having a box-shaped main body provided therein with a heating chamber, a heat source such as a gas burner, a magnetron, and a cooling fan for sending air into a cooling duct, having the magnetron interposed therein, and formed between the cooking device main body and the heating chamber, a one-sided space chamber with a front operation panel and an upper area which extends from the space chamber and is in communication with the atmosphere through an exhaust opening made in the upper portion of the main body. The device includes a control means for application of a high voltage applied through a transformer, or the like, the same contained in the space chamber. The invention is characterized in that the interior of the space chamber is separated by at least one partition wall into a front chamber for containing the control means and a rear chamber for containing the high voltage element. A cooling fan is in communication at its intake side with the interior of the rear chamber, and the forward end of the cooling duct is open to the exhaust opening.

2 Claims, 4 Drawing Figures

COMPOSITE COOKING DEVICE

BACKGROUND OF THE INVENTION

The present invention relates to a composite cooking device having a cooking main body containing a heating chamber provided with a heat source such as a gas burner or the like, and a magnetron so that cooking by the heat of the heat source and/or by the magnetron can, alternatively or selectively, be carried out at the discretion of the operator.

With regard to cooking devices of this kind, there have, in the prior art, been known types in which there was formed, between the cooking device main body and the heating chamber, a one-sided space chamber having a front operation panel control means and a high voltage element, such as a transformer, contained in the space chamber. The space chamber is arranged for air cooling by cooling means such that the control means for the high voltage element may be protected from damage by heat. It is desirable with this type of device that the cooling fan for cooling the magnetron also be utilized for air cooling of the interior of the air chamber.

The present invention has for its object the provision of a cooking device which responds the above set forth needs of the prior art, and improves upon the same.

SUMMARY OF THE INVENTION

The present invention is directed to a composite cooking device in which (a) the main body of a box-type cooking device is provided with a heating chamber, a heat source, a magnetron, and a cooking fan for sending air into a cooking duct having said magnetron interposed therein, further in which (b) there is formed, between the cooking device main body and the heating chamber, a one-sided space chamber with a front operation panel, and an upper space which extends from the space chamber and is in communication with the atmosphere through an exhaust opening made in the upper portion of the main body, yet further in which (c) a control means and high-voltage element, such as a transformer, is contained in the space chamber, wherein the improvement constituting the present invention comprises: (a) the said space chamber having its interior divided by at least one partition wall, said division forming a front chamber adapted for containment of said control means and a rear chamber adapted for containment of said high-voltage element; and (b) said cooling fan being in communication at its intake side with the interior of said rear chamber, wherein the forward end of said cooling duct is in open communication with the exhaust opening of the main body.

DETAILED DESCRIPTION OF THE INVENTION

Figure 1:
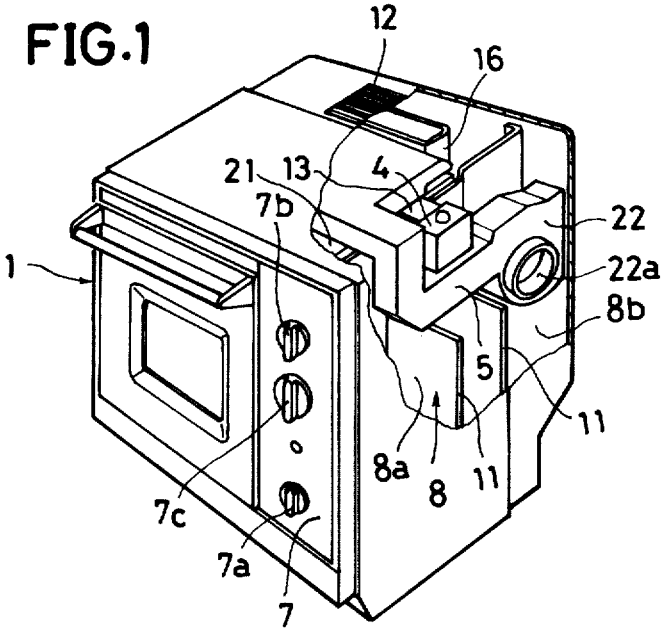
FIG. 1 is a perspective view of one embodiment of the present inventive cooking device.

In a cooking device of the type that a box-type main body 1 is provided therein with a heating chamber 2, a heat source 3 such as a gas burner or the like, a magnetron 4 and a cooling fan 6 for sending air into a cooling duct 5 having the magnetron 4 interposed therein.

There is formed between the cooking device main body 1 and the heating chamber 2 a one-sided space chamber 8 having a front operation panel 7 and an upper space 21 which exfrom the space chamber 8 and is in communication with the external atmosphere through an exhaust opening 12 made in the upper portion of the main body 1. A control means 9 and a high voltage element 10 such as a transformer or the like is contained in the space chamber 8. The invention is characterized in that the interior of the space chamber 8 is partitioned by at least one partition plate 11 into a front chamber 8*a* for containing the control means 9 and a rear chamber 8*b* for containing the high voltage element 10. The cooling fan 6 is in communication at its intake side with the interior of the rear chamber 8*b*, and a forward end of the cooling duct 5 is open to the exhaust opening 12 which, in turn, is in communication through the upper space 21 with the front chamber 8*a*.

Figure 2:
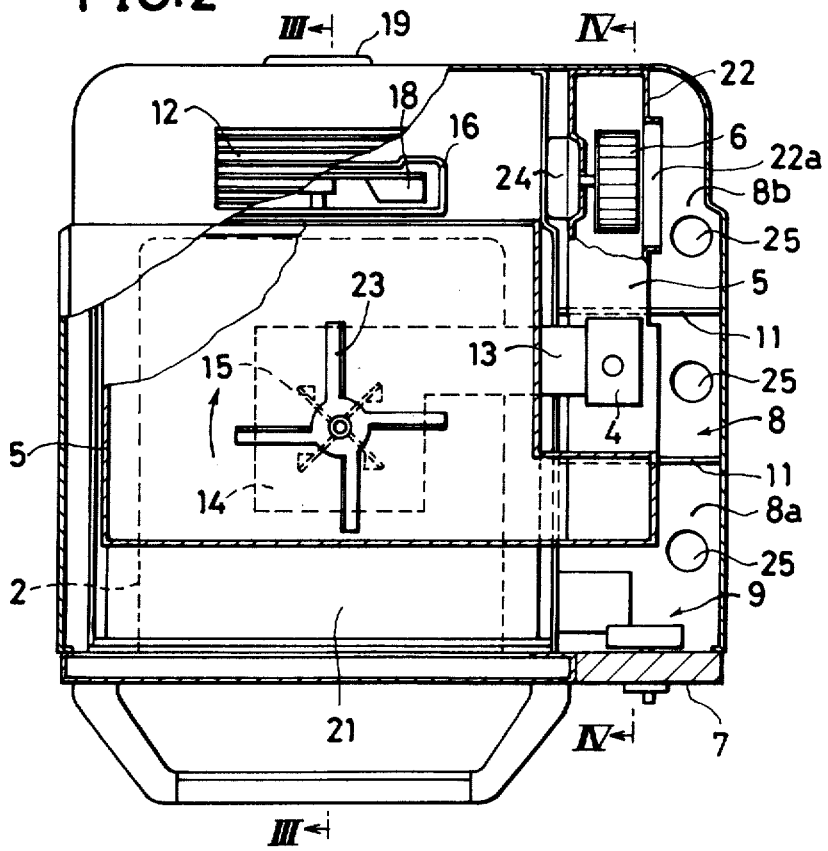
FIG. 2 is a top plan view, partly in section, of the embodiment of FIG. 1.
Figure 3:
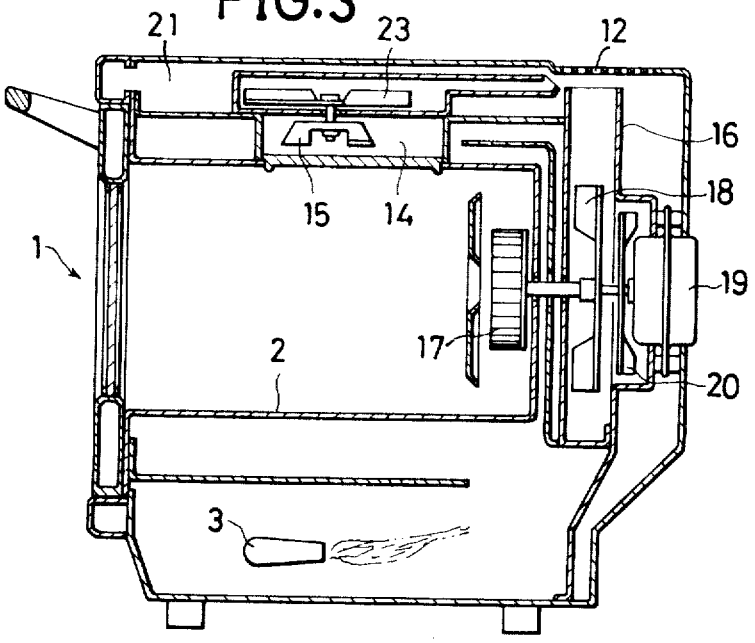
FIGS. 3 and 4 are sectional views taken respectively along lines 3—3 and 4—4 of FIG. 2.
Figure 4:
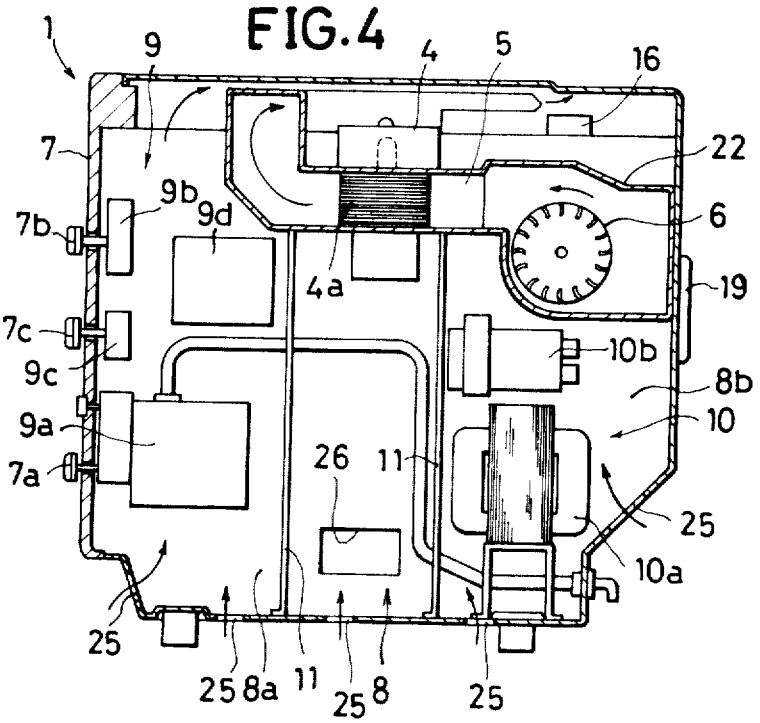

One embodiment of this invention will be further explained with reference to the accompanying drawings: The cooking device main body 1 is adapted into a box-type, one in which the heating chamber 2 is contained such that the space chamber 8 may be formed on the right-hand side of the interior space of the main body 1, as shown in FIGS. 1 and 2. The heat source 3 comprising a gas burner is contained in the cooking device main body 1 below the heating chamber 2, as shown in FIG. 3, so that by the burning of the heat source 3, the interior of the heating chamber 2 is heated from the outside thereof and, thus, a cooking by the heat thereof is carried out.

Additionally, a stirring chamber 14 is connected through a waveguide 13 to the magnetron 4 located on one side thereof. The magnetron is provided on the upper outside of the heating chamber 2 so that by operation of magnetron 4, microwaves are irradiated onto foodstuff in the heating chamber 2 while being stirred by a stirrer 15 provided in the stirring chamber 14 and thus microwave cooking is carried out.

Referring to the drawings, numeral 16 denotes an exhaust duct for discharging hot combustion gases from the heat source 3 to the exhaust opening 12 made in the top wall of the cooking device main body 1. Numeral 17 denotes a circulation fan provided in the heating chamber 2; numeral 18 denotes an exhaust fan provided in the exhaust duct 16; numeral 19 denotes an electric motor for driving the two fans 17 and 18; and numeral 20 denotes a cooling fan for the electric motor 19.

The space chamber 8 is partitioned into a front chamber 8*a* and a rear chamber 8*b* by a pair of front and rear partition walls 11 which are arranged at the middle portion of the chamber 8 so as to be spaced therebetween in parallel, one with another.

The front chamber 8*a* contains the control means 9 comprising a gas control unit 9*a*, such as a gas cock; an electromagnetic valve or the like carrying a cock knob 7*a* attached to the operation panel 7 provided at the front open surface of the front chamber 8*a*; timer units 9*b* and 9*c* carrying timer knobs 7*b* and 7*c*; and an electric unit 9*d* forming a control circuit. The rear chamber 8*b* contains the high voltage applied electric parts 10 comprising a high voltage applied transformer 10*a* and a condenser 10*b*. The front chamber 8*a* is made in communication through the upper space 21, which is formed between the top wall of the main body 1 and the upper wall of the heating chamber 2, with the exhaust opening 12 made in the top wall of the main body of the cooking device 1. The rear chamber 8b is made in communication on its upper side with an intake opening 22a of a fan casing 22 housing the cooling fan 6. The cooling duct 5 in which cooling fins 4a of the magnetron 4 are interposed is connected to an outlet side of the fan casing 22, and the duct 5 extends to pass through the upper space 21 and contains a driving windmill 23 for driving the stirrer 15, and the forward end thereof is open to the exhaust opening 12.

Referring to the drawings, numeral 24 denotes and electric motor for driving the cooling fan 6, numeral 25 denotes external air intake openings made in the lower portions of the front and rear chambers 8a and 8b, and numeral 26 denotes an opening for maintenance used for attaching of a pilot burner and for other purposes.

When the cooling fan 6 is operated, there rises in the rear chamber 8b a drawn current of the external air flowing towards the cooling fan 6 through the external air intake openings 25 from the outside and, thereby, the high voltage elements 10 contained in the chamber 8b are air-cooled. Thereafter, the resultant external air current is flown through the cooling duct 5 and is discharged to the outside through the exhaust opening 12, after being used for cooling of the magnetron 4 and driving of the windmill 23 and, accordingly, the stirrer 15. By the suction force of this discharging air current, the air in the front chamber 8a which is in communication through the upper space 21 with the exhaust opening 12 is drawn and, consequently, there is produced in the chamber 8a a draft, that is, a current of air of the external air directed towards the exhaust opening 12 from the outside through the external air intake openings 25 in the chamber 8a and, by the resultant draft, the control means 9 contained therein and the operation panel 7 on the front surface thereof are air-cooled.

In this connection, such a case can be considered that the interior of the space chamber 8 has no partition and is air-cooled by the cooling fan 6. It is inevitable or necessary in this case that the high voltage element 10 be disposed at the rear portion of the space chamber 8 for reasons of safety and prevention of influence of the high voltage on the control means 9. The cooling fan 6 is also located at the rear portion of the space chamber 8 in order to increase the air-cooling of the high voltage element 10 which is warmed not only by the heat from the heating chamber 2 and the heat source 3, but also by its self-generating heat. Accordingly, the air introduced through the external air intake openings 25, located at the front portion of the air space 8, is deflected into a rearwards flow; that is, toward the rear portion of the space chamber 8 by the suction force of the cooling fan 6, so that there remains, in the vicinity of the front operation panel 7, stagnating hot air by which the panel 7 and the control means 9 are warmed thereby.

According to this invention, the interior of the space chamber 8 is separated by the partition wall 11 into the front chamber 8a and the rear chamber 8b, as mentioned above, so that the direct influence of the suction force caused by the cooling fan 6 on the front chamber 8a is intersected, and there is produced a draft of the external air drawn upwards towards the exhaust opening 12, in which there is produced a current flowing throughout the whole interior of the front chamber 8a, and stagnation of hot air (that is, of heat) is largely avoided.

If the front and rear chambers are partitioned into narrower passages, as illustrated, the external air flowing through each chamber 8a and 8b is improved in its flow rate, and the air-cooling thereby can be more effective.

In the present invention, the space chamber 8 is partitioned into the front and rear chambers 8a and 8b, and the rear chamber 8b is in communication with the intake side of the cooling fan 6 for cooling of the magnetron 7. This enables air-cooling of the high voltage element 10 contained therein. The forward end of the cooling duct 5 connected to the cooling fan 6 is in communication with the exhaust opening 12 which is made in the upper portion of the main body 1 and is in communication through the upper space 21 with the front chamber 8a. This enables a generation in the front chamber 8a of a draft of air flowing upwards along the partition wall 11 and through the upper space 21, towards the exhaust opening 12, by the suction force caused by the discharging current of the air flowing to the exhaust opening 12. Thus, no stagnation of hot air in the front chamber 8a can occur and air-cooling of the control means 9 contained in the front chamber 8a and the front operation panel 7 is effectively accomplished. Additionally, the cooling fan 6 for the magnetron 4 is utilized for the air-cooling, so that the device may be more simply constructed.

Accordingly, while there have been shown and described the preferred embodiment of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

We claim:

1. A composite cooking device in which the main body of a box-type cooking device is provided with a heating chamber, a heat source, a magnetron, and a cooling fan for sending air into a cooling duct having the magnetron interposed therein, further in which there is formed, between the cooking device main body and the heating chamber, a one-sided chamber with a front operation panel and an upper space which extends from the space chamber and is in communication wth the atmosphere through an exhaust opening made in the upper portion of the main body, yet further in which a control means and a high-voltage element, such as a transformer, is contained in the space chamber in which the improvement comprises:

(a) said space chamber having its interior divided by at least one partition wall, such division forming (i) a front chamber adapted for containment of said control means and (ii) a rear chamber for containment of said high voltge element; and (b) said cooling fan in communication at its intake side with the interior of said rear chamber, wherein the forward end of said cooling duct is in open communication with the exhaust opening of the main body.

2. A composite cooking device as recited in claim 1, in which the partition wall comprises a pair of front and rear partition walls which are disposed in parallel, one with another, os as to be distal-proximately separated from each other.

* * * * *